United States Patent [19]

Michlin

[11] 4,191,402

[45] Mar. 4, 1980

[54] FORM FOR CONTROL AND/OR RECORDING PURPOSES

[75] Inventor: Irving R. Michlin, Katonah, N.Y.

[73] Assignee: Transkrit Corporation, Elmsford, N.Y.

[21] Appl. No.: 928,779

[22] Filed: Jul. 28, 1978

Related U.S. Application Data

[63] Continuation of Ser. No. 706,198, Jul. 19, 1976, abandoned.

[51] Int. Cl.[2] ..... B42F 3/00

[52] U.S. Cl. ..... 282/23 R; 282/27 R; 283/63 R

[58] Field of Search ..... 282/22, 23, 25–27, 282/27 A, 11.5 A, 11.5 C; 281/38; 283/63 R

[56] References Cited

U.S. PATENT DOCUMENTS

| | | | |
|---|---|---|---|
| 1,043,511 | 11/1912 | Davidson | 281/38 |
| 1,129,110 | 2/1915 | Montgomery | 282/29 R |
| 1,199,170 | 9/1916 | Friend | 281/38 |
| 1,637,156 | 7/1927 | Mirski | 282/23 R |
| 1,738,633 | 12/1929 | Brown | 282/11.5 R |
| 2,043,182 | 6/1936 | Lewis | 282/22 R |
| 2,614,865 | 10/1952 | Shennan | 282/22 R |
| 2,757,940 | 8/1956 | Moss | 282/23 R |
| 2,835,512 | 5/1958 | Whitman | 282/25 |
| 3,315,984 | 4/1967 | Robertson | 282/22 R |
| 3,987,960 | 10/1976 | Gardiner | 282/25 |

FOREIGN PATENT DOCUMENTS

| | | | |
|---|---|---|---|
| 1245700 | 7/1967 | Fed. Rep. of Germany | 282/22 R |
| 607428 | 8/1948 | United Kingdom | 282/23 R |
| 687354 | 2/1953 | United Kingdom | 282/22 R |
| 860068 | 2/1961 | United Kingdom | 282/23 R |

*Primary Examiner*—John McQuade
*Attorney, Agent, or Firm*—Kenyon & Kenyon

[57] ABSTRACT

The form is constructed of a face sheet, one or more underlying sheets which are die cut into a series of strip portions and a back sheet. The face sheet is divided into an ordered array of sets of designated spaces with each set overlying a strip portion of an underlying sheet so that information recorded on the face sheet is simultaneously recorded on the underlying strips. In addition, the designated spaces may be arranged to impart a cross-footing ability. The underlying strips are removable for use in other processes while the face sheet is retained for control and/or recording purposes. These strips may also contain serial numbers or other coded indicia coded to the face sheet.

12 Claims, 4 Drawing Figures

Fig. 4.

10'

11

16

GOOD BURGERS

| BURGER | CHEESE BURGER | FISH BURGER | BACON BURGER | HOT DOGS | CHICKEN | FRENCH FRIES | COKE | ORANGE | MALTS VA CH ST | TAX |
|---|---|---|---|---|---|---|---|---|---|---|
| QTY PRICE .40 | QTY PRICE .45 | QTY PRICE .45 | QTY PRICE .45 | QTY PRICE .35 | QTY PRICE .85 | QTY PRICE .30 | QTY PRICE .20 | QTY PRICE .20 | QTY PRICE .85 | TOTAL |
| TOT PRICE | TOT PRICE | TOT PRICE | TOT PRICE | TOT PRICE | TOT PRICE | TOT PRICE | TOT PRICE | TOT PRICE | TOT PRICE | |

GOOD BURGERS

| BURGER | CHEESE BURGER | FISH BURGER | BACON BURGER | HOT DOGS | CHICKEN | FRENCH FRIES | COKE | ORANGE | MALTS VA CH ST | TAX |
|---|---|---|---|---|---|---|---|---|---|---|
| QTY PRICE 2 .40 | QTY PRICE .45 | QTY PRICE 1 .45 | QTY PRICE .45 | QTY PRICE .35 | QTY PRICE .85 | QTY PRICE 1 .30 | QTY PRICE 2 .20 | QTY PRICE .20 | QTY PRICE .35 | TOTAL |
| TOT PRICE .80 | TOT PRICE | TOT PRICE .45 | TOT PRICE | TOT PRICE | TOT PRICE | TOT PRICE .30 | TOT PRICE .40 | TOT PRICE | TOT PRICE | 1.95 |

GOOD BURGERS

| BURGER | CHEESE BURGER | FISH BURGER | BACON BURGER | HOT DOGS | CHICKEN | FRENCH FRIES | COKE | ORANGE | MALTS VA CH ST | TAX | |
|---|---|---|---|---|---|---|---|---|---|---|---|
| .40 | .45 | .45 | .45 | .35 | .85 | .30 | .20 | .20 | .35 | TOTAL | 0110 3 |

GOOD BURGERS

| | | | | | | | | | | | |
|---|---|---|---|---|---|---|---|---|---|---|---|
| .40 | .45 | .45 | .45 | .35 | .85 | .30 | .20 | .20 | .35 | TOTAL | 0110 4 |

GOOD BURGERS

| | | | | | | | | | | | |
|---|---|---|---|---|---|---|---|---|---|---|---|
| .40 | .45 | .45 | .45 | .35 | .85 | .30 | .20 | .20 | .35 | TOTAL | 0110 5 |

GOOD BURGERS

| | | | | | | | | | | | |
|---|---|---|---|---|---|---|---|---|---|---|---|
| .40 | .45 | .45 | .45 | .35 | .85 | .30 | .20 | .20 | .35 | TOTAL | 0110 6 |

GOOD BURGERS

| | | | | | | | | | | | |
|---|---|---|---|---|---|---|---|---|---|---|---|
| .40 | .45 | .45 | .45 | .35 | .85 | .30 | .20 | .20 | .35 | TOTAL | 0110 7 |

GOOD BURGERS

| | | | | | | | | | | | |
|---|---|---|---|---|---|---|---|---|---|---|---|
| .40 | .45 | .45 | .45 | .35 | .85 | .30 | .20 | .20 | .35 | TOTAL | 0110 8 |

33

GOOD BURGERS

| | | | | | | | | | | | |
|---|---|---|---|---|---|---|---|---|---|---|---|
| .40 | .45 | .45 | .45 | .35 | .85 | .30 | .20 | .20 | .35 | TOTAL | 0110 9 |

GOOD BURGERS

| | | | | | | | | | | | |
|---|---|---|---|---|---|---|---|---|---|---|---|
| .40 | .45 | .45 | .45 | .35 | .35 | .30 | .20 | .20 | .35 | TOTAL | 0110 10 |

GOOD BURGERS SALES SUMMARY 0110

| BURGER | CHEESE BURGER | FISH BURGER | BACON BURGER | HOT DOGS | CHICKEN | FRENCH FRIES | COKE | ORANGE | MALTS VA CH ST | TAX / TOTAL | |
|---|---|---|---|---|---|---|---|---|---|---|---|
| | | | | | | | | | | | 32 |

FORM FOR CONTROL AND/OR RECORDING PURPOSES

This is a continuation of application Ser. No. 706,198 filed July 19, 1976 now abandoned.

This invention relates to a form for control and/or recording purposes.

As is known, various business forms have been known for recording information in duplicate form. In some cases, the business forms have been of multi-ply construction with sheets, e.g. of carbon paper between the plies or the plies have themselves been treated so as to duplicate information placed on an overlying ply. However, in these cases, the business forms generally use a face sheet which is capable of receiving a single set of information characters or order only.

It is also known that various businesses and institutions require an effective control on inventory in order to reduce or eliminate pilfering. For example, in the case of restaurants of the convenience food and fast-food type, orders for food are frequently taken verbally and either not recorded or recorded only on a two-page type form composed of an original and a carbon copy. In such cases, should the original become lost for any reason, an accurate inventory control of the items sold or the total income received cannot be obtained. Also, in the case of institutions, such as clinics wherein medicines and drugs are prescribed, use of a single carbon-type order form may not be satisfactory for maintaining strict inventory controls of the medicines and drugs dispensed.

In addition, some businesses require a form which can be used to record a multiplicity of transactions while making duplicate copies of each transaction in order to provide for sales audit, for lay-away, and the like. In such cases, the forms which have been used have usually been cumbersome to manipulate and use. In some instances, the forms have been of the shingle type as is known in a variety of peg board systems. These, however, require elaborate arrangements and, in some cases, specialized holders in order to insure correct usage.

Accordingly, it is an object of this invention to provide a form for insuring accurate inventory and sales controls.

It is another object of the invention to provide a form which can be used for a multiplicity of merchandising orders.

It is another object of the invention to provide a form on which a multiplicity of transactions can be recorded and which provides one or more individual duplicate copies of each transaction.

It is another object of the invention to provide a form which can replace forms of the shingle type.

It is another object of the invention to provide a form which can be used for more than one order.

It is another object of the invention to provide a reliable and accurate means of recording information regarding orders for merchandise.

Briefly, the invention provides a form which comprises a face sheet on which a series of separate orders or transactions can be recorded and one or more sheets of separated strip portions which underlie the face sheet.

The face sheet is provided with an ordered array of sets of designated spaces for the recording of information while each strip portion is provided with a duplicate of such spaces. The designated spaces may be arranged in any suitable manner depending upon the use to which the control form is placed. For example, if the form is used by a convenience or fast-food restaurant, the spaces may be designated to record orders of food of various types. In the event that the control form is used by a clinic, the spaces may be designated to receive information regarding the treatment and/or drugs requested by a physician from a pharmacy.

Each of the underlying sheets defines a plurality of separated strip portions, each of which has a surface aligned under a respective set of designated spaces of the face sheet in order to simultaneously receive and record the information placed on a respective set of designated spaces of the face sheet. To this end, use may be made of any suitable transfer system, such as carbon paper, spot carbonizing or other surface mechanical or chemical treatment technique to duplicate the received information. The underlying sheets also have a common tab portion secured to each of the strip portions and a line of weakening between the common tab portion and the strip portions for individual removal of a strip portion from the form.

The construction of the inventory control form is such that information can be imprinted or otherwise impressed within a set of spaces of the face sheet with simultaneous recording on the underlying strip portions of the underlying sheets.

In use, after information has been recorded in an appropriate set of spaces on the face sheet, the underlying strip portions are removed from the form. These removed strips can then be used for subsequent operations. For example, if used in a convenience or fast-food restaurant, one strip portion may be given to a cook to make up the order, while two others are placed on a box or other receptable to receive the ordered goods. After the order has been prepared and placed in the box or other receptable, a cashier, for example, gives one of the two portions of the unit on the box to a delivery person while the other portion is immediately placed in a lock box. The strips accumulated in the lock box can thereafter be used for checking against the face sheet at the end of a suitable time period.

Alternatively, the underlying strip portions may be removed as a unit for the recording of additional information and subsequently bursted apart into individual portions each of which can then be used for different purposes.

By having a series of sets of designated spaces on the face sheet, more than one order or set of information can be recorded. In the case of fast food restaurants, the form allows a summary to be made on the bottom of the face sheet of the various items which have been ordered during the day. In this respect, the face sheets are formed so that the individual spaces are aligned in columns. A simple addition of each column would then give a summary of the total number of each item which has been ordered during the day. This information can then be cross-checked against the various strip portions which are accumulated, for example, in a lock box. For this purpose, the face sheet and each of the strip portions of a form are given a code, such as a serial number, to permit subsequent accumulation and collating of all the separated strip portions relevant to a given face sheet should it be necessary to follow an audit trail.

These and other objects and advantages of the invention will become more apparent from the following detailed description and appended claims taken in conjunction with the accompanying drawings in which:

FIG. 4 illustrates a modified form according to the invention.

Figure 1:
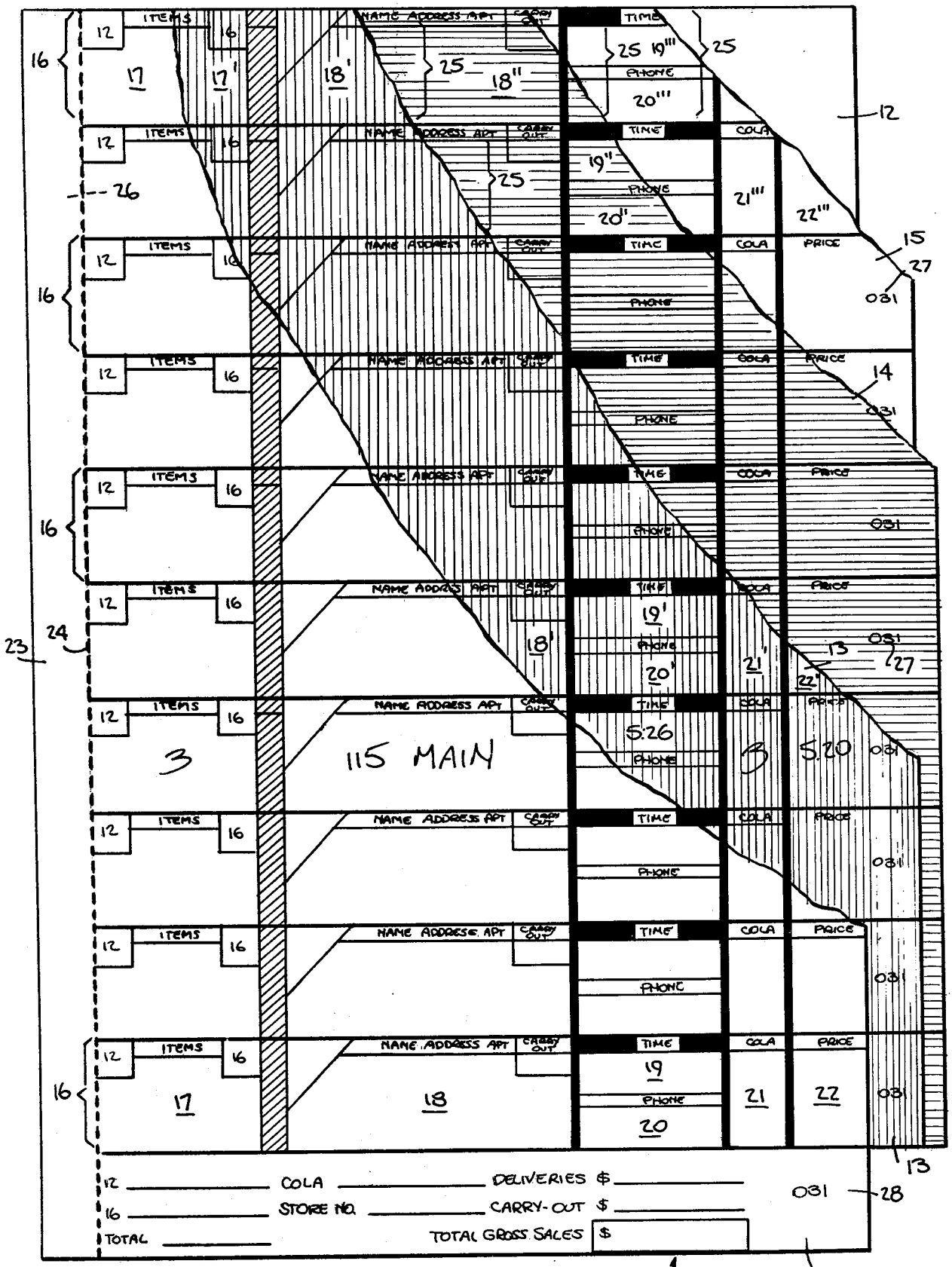
FIG. 1 illustrates a form for use by a convenience or fast-food restaurant in accordance with the invention.
Figure 2:
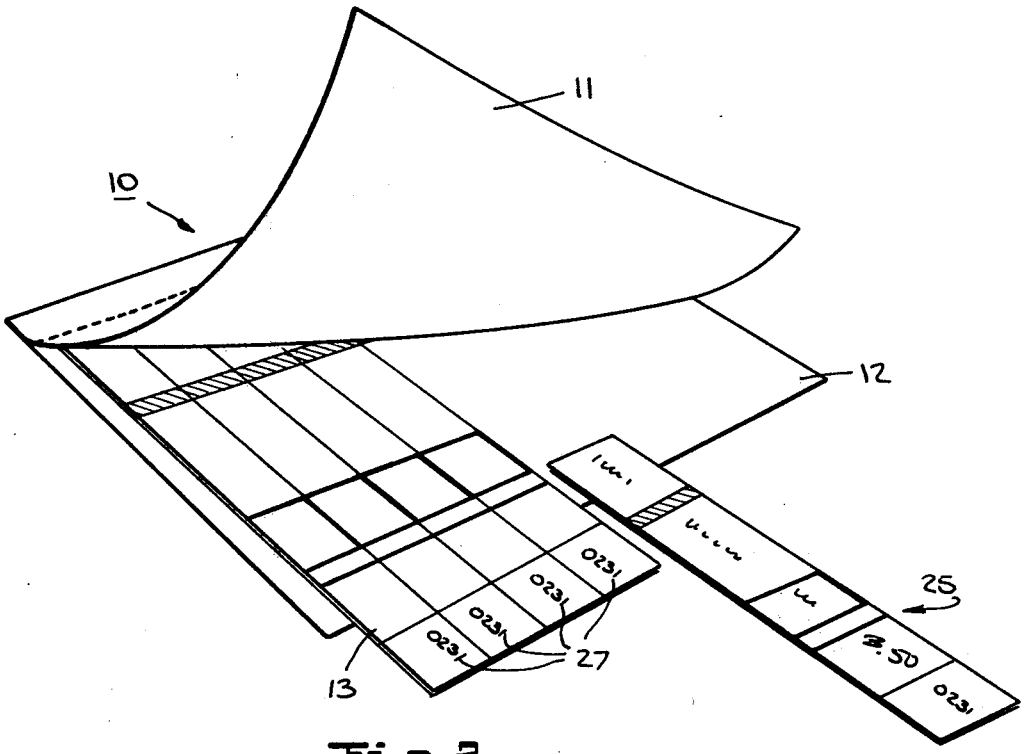
FIG. 2 illustrates a perspective view of a partially used form according to the invention.

Referring to FIGS. 1 and 2, the form 10 which can be used by a convenience food restaurant, such as a pizza parlour, includes a face sheet 11, a back sheet 12 and a plurality of intermediate sheets 13, 14, 15 which are secured together along one side edge to form a single unit.

As shown in FIG. 1, the face sheet 11 includes an ordered array of sets of designated spaces 16 which are preprinted and disposed in horizontal fashion. For example, each set of spaces includes an item space 17 for receiving information concerning an ordered item, a name and address space 18 for identifying a customer ordering the item, a space 19 for indicating the time of ordering, a space 20 to indicate the telephone number of the customer, a space 21 for ordering additional items, for example, soft drinks and finally a space 22 for the total price of the ordered items. The various spaces 17–22 of the sets 16 are arranged in vertical columns so that a summary may be had of the items ordered during a period of time such as one day, or otherwise. Similarly, the total price of the various items ordered can also be summarized. For this purpose, the bottom of the face sheet 11 is provided with suitable spaces for the respective summaries. Also, suitable spaces may be provided for identification of the restaurant, clerk or station.

The face sheet 11 also includes a tab portion 23 along the side and a line of weakening 24 between the tab portion 23 and the remainder of the face sheet 11. This line of weakening 24 allows the preprinted part of the face sheet 11 to be removed from the form 10 after completion and used for recording or control purposes. The tab portion 23 is adhesively secured to the next underlying sheet 13.

The underlying sheets 13, 14, 15 are each of similar construction and for this purpose only one need be further described. As shown in FIGS. 1 and 2, each underlying sheet 13, 14, 15 is formed of a plurality of separated strip portions 25, such as die cut strip portions, and a tab portion 26 secured in common to the strip portions 25. Alternatively, the strip portions 25 may be constructed in other fashions in order to be readily separated from each other. In addition, a line of weakening is disposed between the common tab portion 26 and the strip portions 25 coincident with the line of weakening 24 in the face sheet 11 to permit individual removal of a strip portion 25 from the form. The overlying strips may also be removed as a three-piece snap set. The strip portions 25 of each sheet 13, 14, 15 are horizontally oriented within the form 10 and each has a surface positioned under a respective set of designated spaces 17–22 of the face sheet 11 in order to simultaneously receive and record the information placed in one of the sets of spaces 17–22 on the face sheet 11. The surface cooperates with any suitable transfer system, such as carbon paper, spot carbonized surface or other treated surface in order to receive a duplicate of the information received on the face sheet 11. For example, the underlying sheets 13, 14, 15 are provided with treated surfaces to duplicate the information received on the face sheet 11.

As shown in FIG. 1, each strip portion 25 of an underlying sheet includes preprinted spaces 17′–22′ substantially identical to those of the face sheet and are indicated by single, double and triple prime marks. That is, each strip portion includes one space each for the item ordered, the name and address of the customer, the time of ordering, the phone number of the customer, additional items and price.

The tab portions 26 of the underlying sheets 13, 14, 15 are adhesively secured to each other with the tab of the rearmost underlying sheet 15 adhesively secured to the back sheet 12.

The back sheet 12 is of the same size as the face sheet 11 and forms a back cover for the form 10. In addition, the back sheet 12 may also be used as a duplicate of the face sheet 11. To this end, the back sheet would be provided with ordered arrays of spaces in the same manner as the face sheet and a suitable transfer system, e.g a treated surface type, would be used to duplicate the information recorded on the face sheet 11 and respective portions 25 of the intermediate sheets 13, 14, 15. Alternatively, more than one such back sheet as well as more than one face sheet can be provided.

The intermediate sheets 13, 14, 15 are made of a greater width than the face and back sheets 11, 12 in order to project beyond the face and back sheets 11, 12 and provide a portion which can be easily gripped by a user for removing the imprinted strip portions 25 from the form 10. In addition, each of these projecting portions may be provided with a coded indicia 27, such as a preprinted serial number, which is keyed to a code 28 on the face sheet 11. This allows the separated strip portions 25 to be collected and collated for comparison with the face sheet totals during an audit.

The intermediate sheets 13, 14, 15 may also be made of different colors from the face and back sheets 11, 12 for contract purposes and for ease of use. For example, one sheet may be pink (13), a second yellow (14) and a third white (15).

The strip portions of the last two underlying sheets 14, 15 may also be adhesively secured to each other as by glue spots (not shown) so that upon removal of the respective strips from the form, the topmost strip portion may be directed to one place while the underlying two strip portions are directed to a second place.

Figure 3:
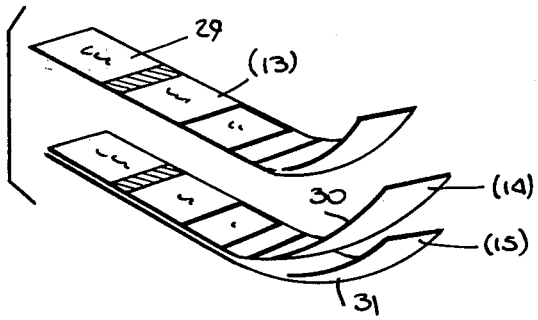
FIG. 3 illustrates an exploded view of the strip portions of a plurality of underlying sheets of the form of FIG. 1.

In use, for example, by a pizza parlour, a telephone order may be received and recorded by placing the appropriate information in the various blank spaces 17–22 of a set of designated spaces 16 on the face sheet 11. Thereafter, the underlying strips 25, namely the pink (29), yellow (30) and white (31) (FIG. 3) copies which receive the same information, are removed from the form 10 by grasping of the projecting portions and tearing along the lines of weakening which secure these strip portions to the common tab portions (FIG. 2). Thereafter, the pink strip 29 may be sent to a cook to prepare the ordered items while the yellow and white strips 30, 31 are placed on a box or other container. When the order is ready and placed in the box, the cashier may remove the yellow strip 30 from the box by simply separating the yellow strip 30 from the white strip 31 and then immediately place the yellow strip 30 in a lock box or the like. The remaining white strip 31 is then given with the box to a delivery person for delivery to a customer, payment being made in accordance with the amount indicated on the white strip 31. At the end of the day, the various items on the face sheet 11 can be totalled to obtain a total of the items ordered and a total sales price. At the same time, the various yellow strips 30 in the lock box can be similarly totalled and the totals of these strips 30 compared to the total of the face sheet 11.

In order to form a unit of the yellow and white strips 30, 31, glue spots (not shown) are provided between these strips. Such glue spots are of a type that permit release of the strips 30, 31 from each other under a manually applied force. In addition, the white strip 31 may be provided on the backside with a suitable adhesive to allow securement to a box or container.

Alternatively, the various colored strips 29, 30, 31 may be used in an interchangeable fashion from that described above.

The above described form may have any suitable number of underlying sheets. For example, a single tear-away sheet may be used in some instances or the sheets may number two, three or four.

The form may be of other constructions. For example, referring to FIG. 4, wherein like reference characters indicate like parts as above, the face sheet 11 of a form 10' is provided at the bottom with a summary section 32 having a horizontal set of spaces corellated to the sets of spaces 16 above. This allows a vertical addition of the information contained in the various vertically aligned spaces and a rapid visual read-out of the totals of the various items.

As also shown in FIG. 4, the face sheet 11 is provided with a series of apertures 33 which permit the face sheet 11 to be collated for processing or for shingling of original forms to develop summary totals or to be retained in a suitable record keeping file.

It is to be noted that any of the above described forms may be provided with feed holes in the tab portions to permit use in automated equipment.

The invention thus provides a simple form which allows a plurality of transactions to be placed on a single face sheet. The invention further provides a form which ensures the integrity of sales personnel.

Further, the invention provides a form which can be used for many different control and recording purposes such as for inventory control, sales audit, lay-away forms and others.

I claim:

1. A form comprising a face sheet having an ordered array of sets of designated spaces thereon for recording of information thereon;

a second sheet underlying said face sheet, said second sheet defining a plurality of separated strip portions, a first common tab portion secured to each of said strip portions, and a line of weakening between said tab portion and said strip portions for individual removal of a respective strip portion from said tab portion, each said strip portion having a surface positioned under a respective set of designated spaces of said face sheet to simultaneously receive and record the information of a respective set of designated spaces thereon; and a third sheet underlying said second sheet, said third sheet defining a plurality of separated strip portions, a second common tab portion secured to each of said strip portions of said third sheet and a line of weakening between said second tab portion and said strip portions of said third sheet for individual removal of a respective strip portion from said second tab portion, each said strip portion of said third sheet having a surface positioned under a respective strip portion of said second sheet to simultaneously receive and record the information of said respective strip portion of said second sheet thereon.

2. A form as set forth in claim 1 which further comprises a back sheet underlying said third sheet and secured to said tab portion of said third sheet, said back sheet having an ordered array of sets of designated spaces to simultaneously receive and record the information recorded on said face sheet.

3. A form as set forth in claim 2 wherein said face sheet and said back sheet are of equivalent size and said second and third sheets are of greater width than said face and back sheets to project beyond said face and back sheets and to receive a coded indicia thereon keyed to a code on said face sheet.

4. A form as set forth in claim 1 which further comprises a fourth sheet underlying said third sheet, said fourth sheet defining a plurality of separated strip portions, a third tab portion secured to each of said strip portions of said fourth sheet and a line of weakening between said third tab portion and said strip portions of said fourth sheet for individual removal of a respective strip portion from said third tab portion, each said strip portion of said fourth sheet having a surface positioned under a respective strip portion of said third sheet to simultaneously receive and record the information of said respective strip portion of said third sheet thereon.

5. A form as set forth in claim 4 wherein said strip portions of said third and fourth sheets are releaseably secured together.

6. A form as set forth in claim 5 which further comprises a back sheet underlying said fourth sheet and secured to said tab portion of said fourth sheet, said back sheet having an ordered array of sets of designated spaces to simultaneously receive and record the information recorded on said face sheet.

7. A form as set forth in claim 4 wherein at least one of said second, third and fourth sheets as a self-adhesive surface on a backside thereof.

8. A form as set forth in claim 1 wherein said strip portions of said second and third sheets are horizontally oriented.

9. A form as set forth in claim 1 wherein each said set of designated spaces and each said strip portions are pre-printed with identical indicia.

10. A form as set forth in claim 1 wherein said face sheet has a summary section below said sets of designated spaces to receive totals of the information in said sets of designated spaces.

11. A form consisting of a face sheet having an ordered array of horizontal sets of designated spaces thereon for recording of information thereon with said spaces being aligned in columns, said face sheet having a tab portion along one side, a line of weakening between said face sheet and said tab portion, and a summary section below said sets of designated spaces to receive totals of the information in said sets of designated spaces and a code thereon:

a second sheet underlying said face sheet, said second sheet defining a plurality of horizontally oriented separated strip portions, a second tab portion underlying said tab portion of said face sheet and secured to each of said strip portions of said second sheet, and a line of weakening between said second tab portion and said strip portions of said second sheet for individual removal of a respective strip portion from said second tab portion, each said strip portion of said second sheet having a surface positioned under a respective set of designated spaces of said face sheet to simultaneously receive and record the information of a respective set of designated spaces thereon; and a third sheet underlying said second sheet, said third sheet defining a plurality of horizontally oriented separated strip portions, a third tab portion secured to each of said strip portions of said third sheet and a line of weakening between said third tab portion and said strip portions of said third sheet for individual removal of a respective strip portion of said third sheet from said third tab portion, each said strip portion of said third sheet having a surface positioned under a respective strip portion of said second sheet to simultaneously receive and record the information of said respective strip portion of said second sheet thereon;

said sheets being secured together along one side edge at said tab portions to form a single unit with said second and third sheets being of greater width than said face sheet to project beyond said face sheet to provide a projecting portion to facilitate removal of each strip portion from said unit; and coded indicia on at least said strip portions of said second sheet keyed to said code on said face sheet, said coded indicia being disposed on said projecting portions of said second sheet.

12. A form consisting of a face sheet having an ordered array of horizontal sets of designated spaces thereon for recording of information thereon with said spaces being aligned in vertical columns, said face sheet having a tab portion along one side, a line of weakening between said face sheet and tab portion, and a summary section below said sets of designated spaces to receive totals of information in said designated spaces of each respective column;

a second sheet underlying said face sheet, said second sheet defining a plurality of horizontally oriented separated strip portions, a second tab portion underlying said tab portion of said face sheet and secured to each of said strip portions of said second sheet, and a line of weakening between said second tab portion and said strip portions of said second sheet for individual removal of a respective strip portion of said second sheet from said second tab portion, each said strip portion of said second sheet having a surface positioned under a respective set of designated spaces of said face sheet to simultaneously receive and record the information of a respective set of designated spaces thereon; and a third sheet underlying said second sheet, said third sheet defining a plurality of horizontally oriented separated strip portions, a third tab portion secured to each of said strip portions of said third sheet and a line of weakening between said third tab portion and said strip portions of said third sheet for individual removal of a respective strip portion of said third sheet from said third tab portion, each said strip portion of said third sheet having a surface positioned under a respective strip portion of said second sheet to simultaneously receive and record the information of said respective strip portion thereon;

said sheets being secured together along one side edge at said tab portions to form a single unit with said second and third sheets being of greater width than said face sheet to project beyond said face sheet to facilitate removal of each strip portion from said unit.

* * * * *

UNITED STATES PATENT AND TRADEMARK OFFICE

CERTIFICATE OF CORRECTION

PATENT NO. : 4,191,402

DATED : March 4, 1980

INVENTOR(S) : IRVING R. MICHLIN

It is certified that error appears in the above—identified patent and that said Letters Patent is hereby corrected as shown below:

Column 3, line 41, after "purposes" insert --or for recording and control purposes--

Column 6, line 41, change "as" to --has--

Column 6, line 62, change ":" to --;--

Signed and Sealed this

*Fifteenth* Day of *July 1980*

[SEAL]

*Attest:*

SIDNEY A. DIAMOND

*Attesting Officer*

*Commissioner of Patents and Trademarks*